United States Patent [19]

Olsen

[11] Patent Number: 4,692,087

[45] Date of Patent: Sep. 8, 1987

[54] HANDLING SYSTEM AND METHOD FOR SHIP CONSTRUCTION AND REPAIR

[75] Inventor: Ralph A. Olsen, Santa Barbara, Calif.

[73] Assignee: Ametek, Inc., Santa Barbara, Calif.

[21] Appl. No.: 549,268

[22] Filed: Nov. 4, 1983

[51] Int. Cl.[4] ..... B66F 9/00; B66F 9/06

[52] U.S. Cl. ..... 414/680; 414/589; 414/734; 901/15; 901/21; 114/65 R; 187/8.71; 254/9 R

[58] Field of Search ..... 414/589, 590, 680, 729, 414/730, 734; 901/15, 25, 21, 22; 114/65 R; 244/137 R, 54; 248/274–278, 241; 187/18, 8.21; 254/8 R, 9 R

[56] References Cited

U.S. PATENT DOCUMENTS

| | | | |
|---|---|---|---|
| 2,785,807 | 3/1957 | Prowinsky | 414/589 |
| 2,929,519 | 3/1960 | Taylor | 414/590 |
| 2,940,769 | 6/1960 | Taylor | 414/590 X |
| 3,003,653 | 10/1961 | Wirkkala | 414/734 X |
| 3,065,863 | 11/1962 | Saunders, Jr. | 901/21 X |
| 3,241,687 | 3/1966 | Orloff | 901/15 X |
| 3,667,632 | 6/1972 | Tidswell | 414/680 |
| 3,844,421 | 10/1974 | Nielsen | 254/8 R X |
| 4,048,936 | 9/1977 | Uchizono et al. | 114/65 R |
| 4,188,165 | 2/1980 | Bohme et al. | 414/694 |
| 4,199,294 | 4/1980 | Streck et al. | 901/25 X |
| 4,360,187 | 11/1982 | Chapman | 254/8 R |
| 4,544,322 | 10/1985 | Booker | 414/589 |

FOREIGN PATENT DOCUMENTS 1171584 6/1964 Fed. Rep. of Germany ..... 187/8.71

*Primary Examiner*—Robert J. Spar
*Assistant Examiner*—P. McCoy Smith
*Attorney, Agent, or Firm*—Michael D. Harris

[57] ABSTRACT

The handling apparatus includes two spaced apart lower arms pivoting on a base, and two spaced apart upper arms pivoting on an elbow bearing on the lower arms. The lower arm is driven by a ball-screw arrangement in which a threaded drive, mounted on the base of the apparatus is connected to a ball screw attached to a strut between the ball screw and the lower arm. Moving the ball screw along the threaded drive member pivots the lower arm upward. Another ball screw arrangement is mounted on the lower arm and is attached to the lower end of the upper arm by means of cables that extend along a rear curved surface of the upper arm to allow for more travel of the upper arm. Various attachment can be mounted on the upper arm including hangers for propellers and rudders and a gripper unit for supporting propeller shafts. When handling propellers and rudders, a single material handling unit is used, and the propeller or rudder is hung between the spaced apart arms. When moving long objects such as propeller shafts, two handling units are used together in coordinated movement.

8 Claims, 10 Drawing Figures

FIG.2.
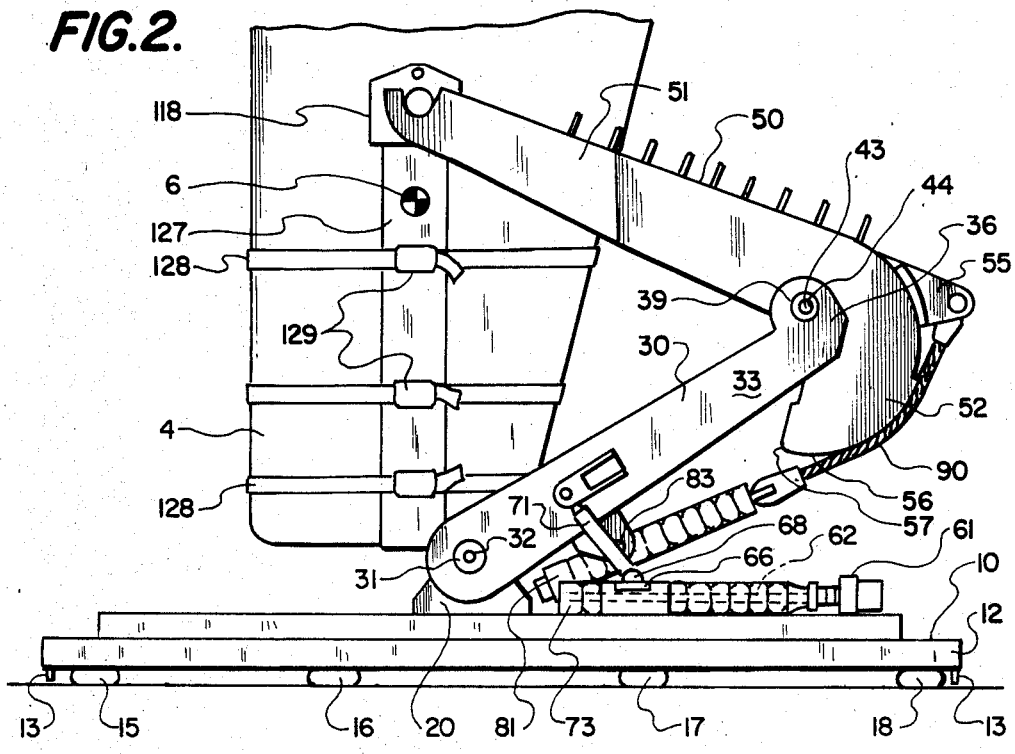
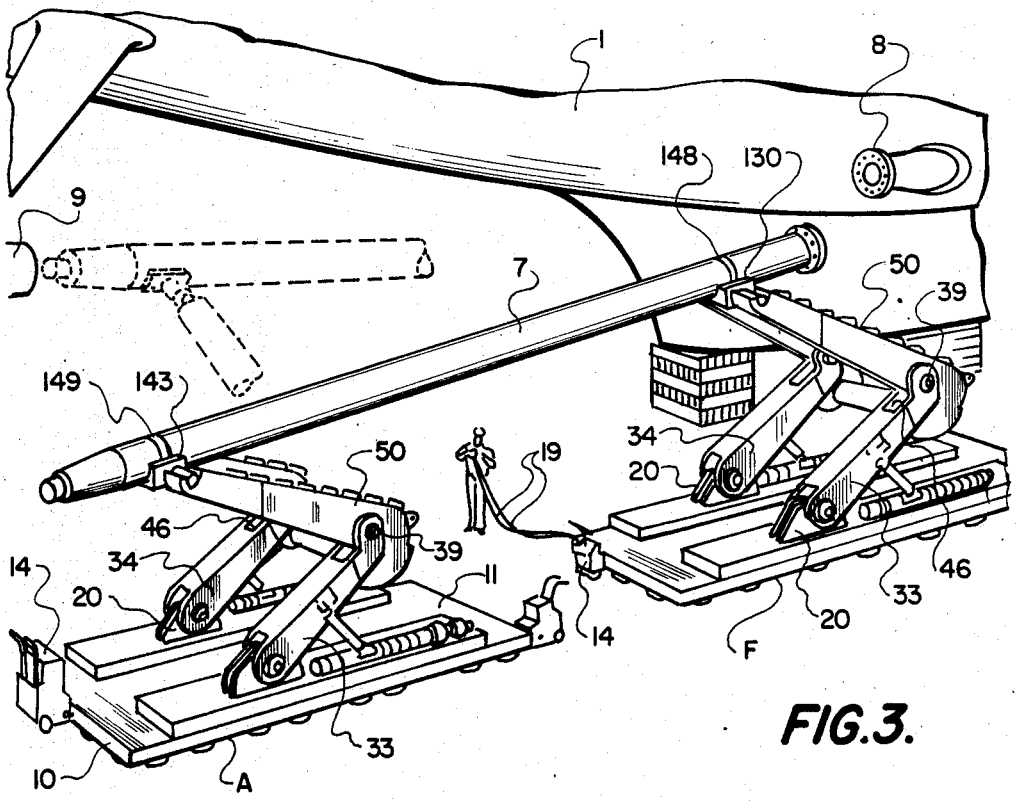
FIG.3.

FIG. 4.
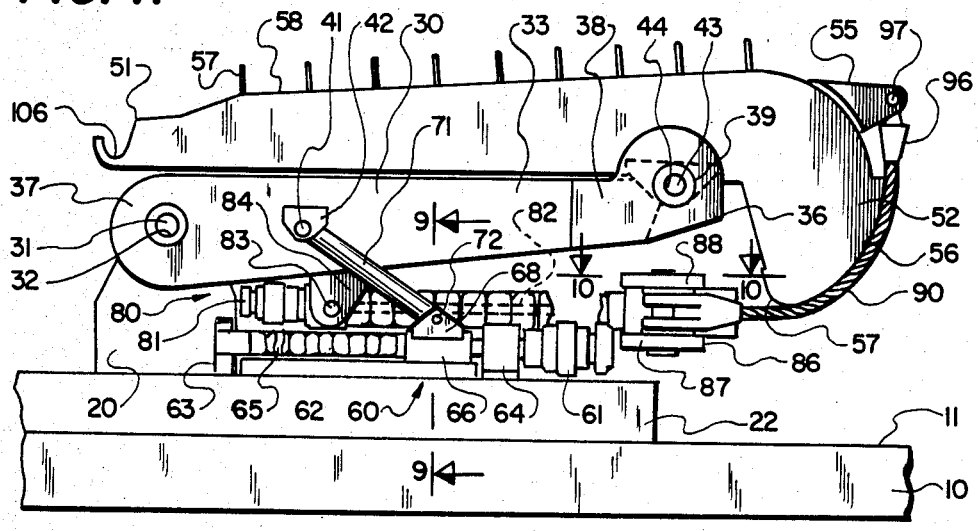
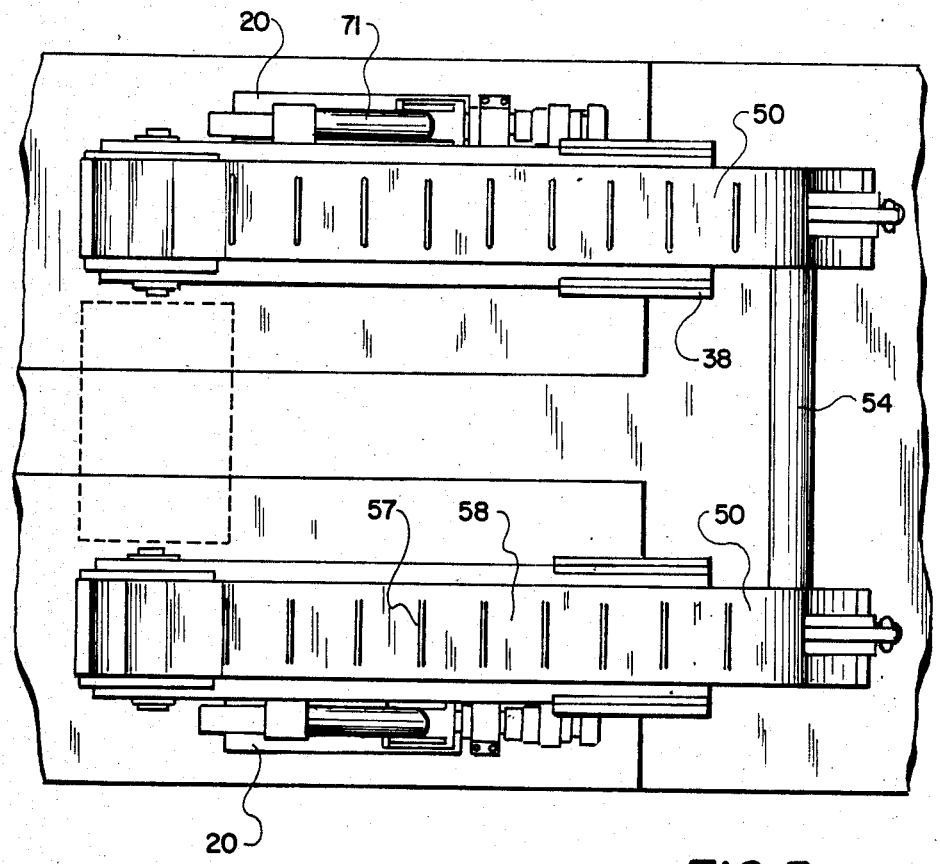
FIG. 5.

HANDLING SYSTEM AND METHOD FOR SHIP CONSTRUCTION AND REPAIR

BACKGROUND OF THE INVENTION

1. Field of Invention

The present invention relates to a handling method and system for ship construction and repair especially for the removal or installation of the propeller shafts, propellers, rudder and other heavy, large objects on the underside of the hull of a large ship.

2. Description of the Prior Art

Hydrodynamic efficiency, strength and functional capability are the principal design considerations that establish size, location and surface contours of ship propellers, propulsion shafts and rudders. Little, if any, consideration is incorporated into the design to facilitate the removal or installation of these parts or to improve the shipyard handling. There is also little standardization in the size of parts in order to meet different design criteria for different types of ships. The propellers, shafts, and rudders of a supertanker meet very different design criteria than those for a high speed naval vessel or those of a small freighter.

Accordingly, handling methods, which have been generally very labor intensive, evolved to accommodate wide variations in shape and size of the major components. The most common method employs many pad-eyes welded to the underside of the hull from which chain falls are attached and extend downward to be secured to the component, i.e. the propeller, shaft or rudder. These components are then moved by continuously adjusting the chain falls and moving the components along the chain falls until the main shipyard overhead crane can secure the component and move it. The shipyard crane can only reach the component when the component is moved from under the hull.

A variety of adjustable dollies and support cribbing has also been used but these methods proved unsatisfactory in part, because of the wide variations in component sizes and the variations in hull shape. With some ships, the propeller shafts, for example, are quite high off the drydock floor. The same ship, however, may have a shaft located closer to the keel that will be somewhat nearer to the drydock floor. It is often very different to move in the close locations. Therefore, typical forklift trucks and variations have proved unsatisfactory.

Many of the past techniques rely on building scaffolding under the ship, but scaffolding interferes with free movement of materials. Moreover, scaffolding might also interfere with work platforms around the vessel.

Propeller shafts create particular problems because of their length and weight. Some exceed 40 feet (12 m), and they may have a maximum diameter of approximately 24 inches (61 cm). (All metric conversions are approximate.) The shafts may weigh up to about 60 tons (54 metric tons). Drydock floors are not always smooth and level. Many have deep, wide grooves for recessing bilge block chains. For example, one shipyard has 6×18 inch (15×45 cm) wide grooves at about 10 foot (3 m) intervals. A typical wheeled forklift has difficulty functioning with the grooves. Also, forklift, wheeled chassis tend to be built high.

One previous system uses heavy-duty electric forklift trucks having a high lift platform. Special pallets are fixed to the platform of the forklift truck. Each platform has an approximately 10 foot (3 m) square channel frame divided into two sections. Each section has a sliding bridge that spans the width of the frame, and a carriage slides inside each bridge. The top of each carriage has a telescoping mast with specialized load arms on top. One load arm handles small propellers, another holds small rudders, and another has gimbals and a saddle for handling propeller shafts. The bridges within the pallet, the carriagse within the bridges, and the telescoping uprights on the carriages are each powered hydraulically to move in two directions. This combined movement provides for four-way movement of each upright in the horizontal plane and two-way movement of the load arms on the uprights.

For long propeller shafts, two trucks with separate pallets are used, and their movement are coordinated. For installing or removing large rudders or propellers, two trucks travelling abreast must be used to pick up a saddle assembly that holds the rudder or propeller. Because of height limitations imposed on the system, it is difficult to move propeller shafts that are mounted near the drydock floor and on the same piece of equipment reach propeller shafts located very high. It is also difficult to coordinate the movement of the telescoping arms and the trucks, especially when they are required to move together. When carrying rudders or propellers between two trucks, the load on each truck is also well off the center of gravity, which tends to tilt both trucks toward each other.

For proper movement, propeller shafts should seat properly in the carriage, but it is somewhat time consuming to align the entire truck perfectly. Therefore, it would be desirable to provide some play in the carriage so that the device is self-aligning.

The wide variety of propeller sizes and their varied rake and pitch causes significant difficulties in handling propellers. Where the rudder or propeller are positioned near the back wall of the drydock, movement of handling systems is frequently restrictive.

SUMMARY OF THE INVENTION

It is an object of the present invention to solve the problems previously mentioned. Particularly, it is an object to disclose and provide a handling system that can drastically reduce the time necessary for removal and installation of propellers, rudders and propellers shafts. To accomplish this object, the system must be designed to handle rudders, propellers and propeller shafts with their unique configurations with minimum change-over. The handling apparatus must also be compatible with the drydock overhead crane so that once the ship components are removed from their locations by the handling system, the overhead crane can move them to locations where they can be repaired.

Another object of the present invention is to disclose and provide handling apparatus that can reach to high locations on the underside of the vessel and still clear and be able to handle shafts near the drydock floor from below. Another object is to avoid having to coordinate movements of two separate trucks and telescoping arms when working on depending loads such as the rudder and propeller.

Another object is to disclose and provide a materials handling device with self-aligning features for securing cylindrical shafts.

These and other objects will become evident in the description of the preferred embodiment of the invention. To meet the objects, the material handling apparatus of the present invention includes a base, a pair of lower arms pivoting on the base and a pair of upper arms pivoting on the lower arms at an elbow pivot. The lower arms are driven by a pair of threaded shafts mounted on the base. A ball screw nut travels along the threaded shaft as the shaft is rotated by a hydraulic motor. The ball screw nut is attached to a pivoting strut that extends to the lower arm, and as the ball screw nut moves along the threaded shaft, the strut pushes the lower arm upward or allows it to pivot downward. Another pair of threaded shafts are mounted on the lower arm and have ball screw nuts mounted on them. Cables are attached to each of the ball screw nuts, and the cables extend around a curved portion at the lower end of the upper arms. When the ball screw nuts pull on the cables, the cables pull the lower end of the upper arms downward to pivot the upper arms around the elbow bearing.

Various attachments are mounted to the upper end of the upper arms. One attachment is a pivoting box-like structure with a curved cutout to support propeller shafts. The supporting member is also allowed limited rotation about the vertical axis to compensate for the shaft's alignment. Supports are also provided for carrying a propeller, and the arms are spaced sufficiently apart to provide for room for wide propellers between the arms. Another type of carriage is provided for supporting a rudder, and that carriage includes a sling for extending around the bottom of the rudder. The handling apparatus moves on an air bearing, and it can be easily positioned and maneuvered as desired.

BRIEF DESCRIPTION OF THE DRAWINGS

Then drawing Figures are presented on four sheets. On Sheet 1.

On Sheet 2, FIG. 2 is a side elevation of the handling apparatus of the present invention carrying a rudder.

FIG. 3 is a perspective view of the material handling apparatus of the present invention in which two units are coordinating movement to move a propeller shaft.

On Sheet 3, FIG. 4 is a side elevation of the material handling apparatus of the present invention in which the upper and lower arms are in their lowest position.

FIG. 5 is a top view of the material handling apparatus of the present invention.

On Sheet 4.

DETAILED DESCRIPTION OF THE PREFERRED EMBODIMENT

The Base

Figure 1:
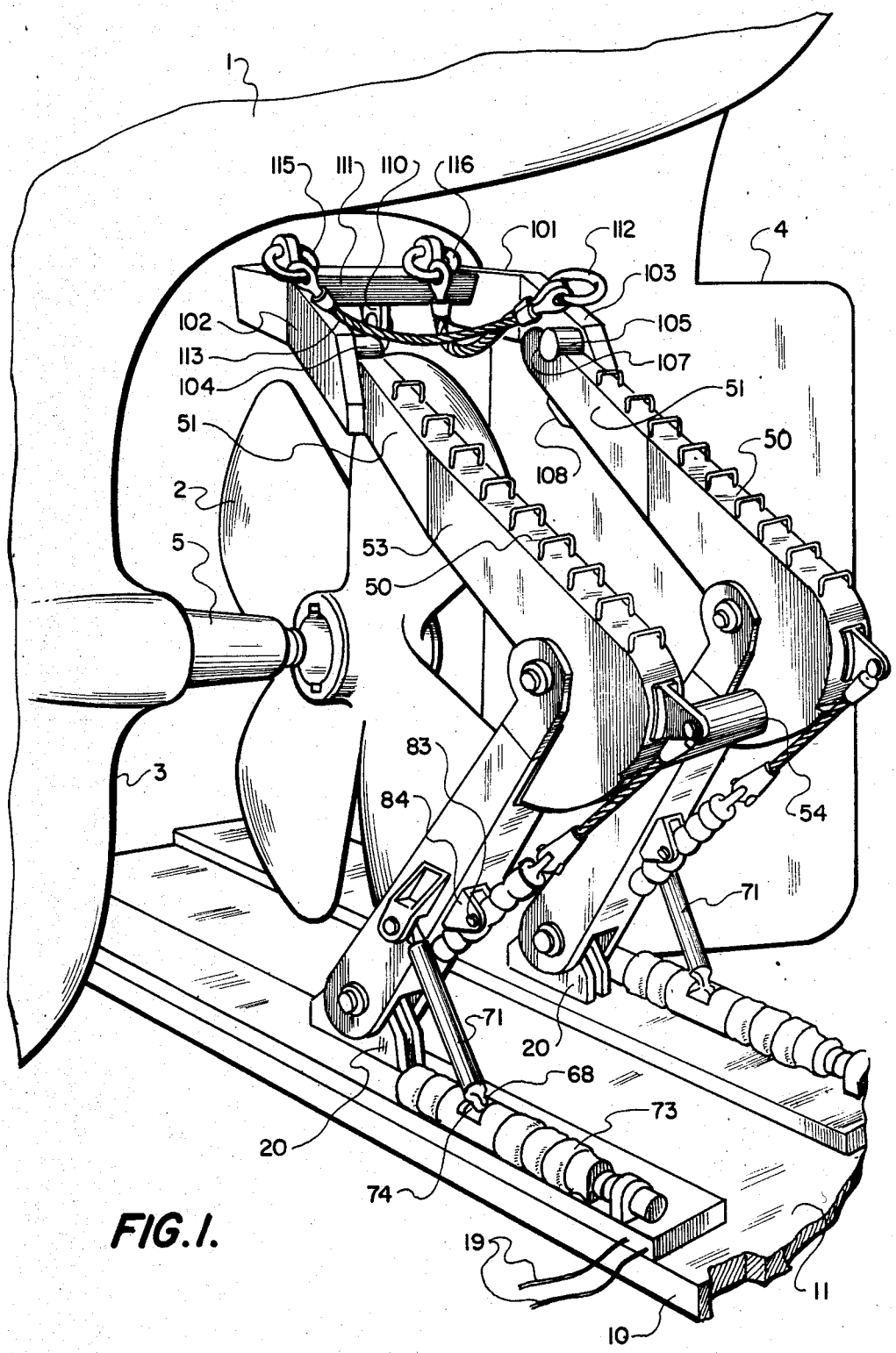
FIG. 1 is a perspective view of the handling apparatus of the present invention carrying a propeller.

In the exemplary embodiment, base 10 of the material handling apparatus of the present invention is rectangular in shape. The base may be formed in a variety of ways, but for strength, it may be formed of a box-beam arrangement out of square steel tubing. The beams may double as hydraulic or pneumatic reservoirs. Preferably, plate 11 is mounted on the base to create a working or walking surface.

Although base 10 can be mounted on wheels for moving along the dry dock floor, the present invention utilizes an air pallet moving system. Because many dry dock floors have large grooves to recess bilge block chains, wheeled handling apparatuses have difficulty in moving along a dry dock floor. Moreover, an air pallet transport system provides complete freedom of movement in all horizontal directions to assist in tight maneuvers.

Although not shown in detail, the air baring transporter is contained below base 10. Known air pallets are available including an air pallet sold under the trademark Rolair. Sixteen air bearings each 28 inches (71 cm) in diameter are mounted in quick-change slides on the lower surface of base 10. The bearings 15, 16, 17, and 18 (FIG. 2) are preferably arranged in four rows of four bearings each. The load carrying capacity is sufficient if the dry dock floor groves cause loss of air from a transverse row of four bearings. In normal operation, this capability should not be required because insert caps may be placed in the dry dock grooves to prevent air loss.

Sides 12 of base 10 overhang the air bearings. Steel legs 13 (FIG. 2) touch the ground when the air bearings are turned off, but the legs rise to clear the ground when the air bearings are turned on. A set of drive wheels 14 (FIG. 3) is mounted at each end of the pallet. The drive wheels are manuall trained in the direction of movement desired and pneumatic or hydraulic cylinders position of wheels downward to engage the dry dock floor when the entire apparatus is being moved. The wheels are preferably driven by a pneumatic motor. Regulators associated with the motors will drive the apparatus from a low creep speed of approximately 3 ft/min (1 m/min) to a maximum traverse speed of approximately 30 ft/min (9 m/min).

A large cage (not shown) may be mounted on one side of base 10 to house the various motors and power supplies and to supply hydraulic power to the hydraulic motors and compressed air to the air bearings. A platform on the cage would provide a working area for the operator. Workers on floor may also operate the units through control cable 19 (FIG. 3) or through radio control. Controllers can coordinate the movement of the unit so that they move together if necessary.

Upper and Lower Arms

Two triangularly shaped pedestals 20 (FIGS. 1–5) extend upward from base 10. Pedestals 20 are integrated into the structure of the frame of the base. Their triangular design provides maximum bending and torsional strength while minimizing weight.

The apparatus includes a pair of spaced apart lower arms. In the exemplary embodiment, each lower arm 30 has a first end which is pivotally mounted on pedestal 20 in that trunnion 31 extends through bearing 32 in the lower arm and a bearing in pedestals 20 (FIGS. 1–4). Lower arm 30 has two sides 33 and 34 which are spaced a distance apart slightly greater than the thickness of pedestal 20, and trunnion 31 extends through both sides 33 and 34. Lower arm 30 is formed in a box-beam construction and made of steel for maximum bending torsional strength. Openings may be provided to minimize weight and bulkheads provide added strength.

The apparatus also includes a pair of upper arms each having first and second ends. In the exemplary embodiment, upper arms 50 are formed of a similar construction but of a different shape to that of lower arms 30. The second end 51 of upper arm 50 is the load carrying end and is described in greater detail below. Upper arm 50 pivots on second end 36 of lower arm 30 near first end 52 of upper arm 50. Lower arm 30 includes check plates 38, which support elbow joint 39. Elbow joint 39 includes a journal shaft 43 that extends through lower arm 30 and upper arm 50 at bearing 44 (FIGS. 2 and 4). As shown in FIGS. 1 and 3, upper arms 50 are mounted inside lower arms 30. First end 52 of upper arm 50 acts as a counter balance against the weight of objects on the load carrying second end 51 of upper 51. An access ladder in the form of spaced steel rings 57 is attached to the upper surface 58 of upper arm 50 so that personnel can climb along the upper arm to the second end 51.

Drives for the Arms

Lower drive means extending between base 10 and lower arm means 30 pivot the lower arm about bearing shaft 31 on pedestal 20. As shown particularly in FIG. 4, lower drive means 60 comprises a first drive member in the form of hydraulic motor 61 and threaded shaft 62, which may be directly mounted on plate 11 of base 10 or, as shown in the exemplary embodiment of FIG. 4, mounted on side platform 22. Motor 61 rotates threaded shaft 62 which is supported on bearings 63 and 64 (FIG. 4). There may be gears between motor 61 and shaft 62 for controlling the speed of rotation of the shaft.

Figure 9:
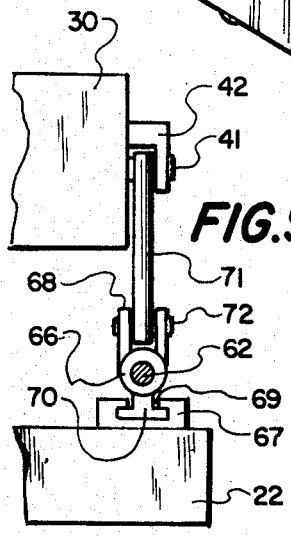
FIG. 9 is a sectional view of the drive mechanism that drives the lower arm taken through plane 9—9 of FIG. 4.

Engaging means in the form of ball screw nut 66 with internal threads is threaded onto external threads 65 of shaft 62 so that rotation of the shaft moves ball screw nut 66 to right and left (FIG. 4) along shaft 62. Guide means are provided adjacent the threaded shaft for receiving and guiding a portion of ball screw net 66 to prevent nut 66 from rotating with the threaded shaft. As shown in primarily FIG. 9, when shaft 62 rotates, there would be a tendency for nut 66 to rotate with the rotation of shaft 62. Guide 67, which has a T-shaped opening 69, receives T shaped bracket 70 extending downward from nut 66. Because guide 67 is anchored to platform 22, nut 66 cannot rotate.

Strut 71 (FIGS. 1–5) extend from ball screw nut 66 to lower arm 30. In the exemplary embodiment, strut 71 pivots on shaft 72 through a bearing in the upper portion 68 of nut 66 (FIG. 9) and extends a shaft 41 extending through bracket 42 on lower arm 30.

As motor 61 rotates shaft 62 in one direction, nut 66 moves either to the left or right (FIG. 4). As it moves to the left, strut 71 pushes on bracket 42 and lower arm 30 to rotate lower arm 30 counterclockwise (FIG. 4). Note the change in position of lower arm 30 between FIGS. 2 and 4 as nut 66 moves to the left.

The length and position of the lower drive means 60 is chosen such than lower arm 30 can move from its generally horizontal position in FIG. 4 through an intermediate position in FIG. 2 and FIG. 1 until it reaches an almost vertical position.

A cover 73 (FIGS. 1 and 2) extend around shaft 62 to protect shaft 62 and acts as a guard. Upper portion 68 of ball screw nut 66 extends upward through opening 74 in cover 73. The material of which cover 73 is formed is pleated to act in an accordion-like manner so that the portions of cover 73 on either end of opening 74 expand or contract as nut 66 moves along threaded shaft 62.

Figure 10:
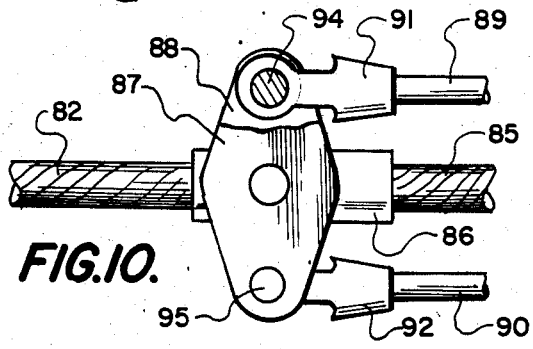
FIG. 10 is a sectional view taken through plane 10—10 of FIG. 4 showing part of the detail of the drive means for the upper drive.

Upper arm 50, as previously stated, pivots on elbow bearing 39 located between second end 51 and first end 52 of upper arm 50. The upper arm 50 is driven by a mechanism somewhat similar to the mechanism that drives the lower arm. The upper drive means 80 that drives upper arm 50 relative to lower arm 30 comprises an upper hydraulic motor 81 that drives a threaded shaft 82 within accordion-like cover 73 (FIGS. 1, and 4). Unlike lower drive 60 which is stationary on base 10, upper drive 80 pivots on trunnions 83 journaled into downward extending bracket 84 on lower arm 30 (FIGS. 1, 2 and 4). A traveller in the form of threaded ball screw nut 86 (FIGS. 4 and 10) mounted on shaft 82 engages threads 85 on shaft 82. A pair of plates 87 and 88 (FIGS. 4 and 10) are mounted to ball screw nut 86, and a pair of wire ropes 89, 90 are attached to plates 87 and 88 by means of connectors 91 and 92 and attaching pins 94 and 95 (FIG. 10). The other ends of wire ropes 89 and 90 are connected to a connector 96 which is in turn pivotally mounted on shaft 97 extending through bracket 55 (FIGS. 2 and 4) on the lower end 52 of upper arm 50.

As shown primarily in FIG. 2 and 4, wire ropes 89 and 90 (only 90 is visible) extend along curved surface 56 of first end 52 of upper end 50 to bracket 55. If wire ropes 89 and 90 were attached near corner 57 (FIG. 2 and 4), for example, as upper arm 50 pivoted clockwise, pivoting of upper arm 50 could not go beyond the point that edge 57 is aligned with trunnion 83 and elbow joint 39. With the attachment of wires 89 and 90 to bracket 55 at the location shown in the exemplary embodiment, full pivoting of upper arm 50 can take place. As upper arms 50 continue to pivot clockwise, part of first portion 52 of upper arms 50 pivot between inside wall 34 and outside wall 33 of lower arm 30 (FIG. 1) through space 46 (FIG. 3).

The pivoting occurs when ball screw 86 travels treaded shaft 82. By having parallel wires 88 and 89, ball screw nut 86 does not rotate when shaft 82 rotates. It merely travels along shaft 82 pulling or releasing wire ropes 89 and 90 to pivot upper arm 50 about elbow joint 39 on lower arm 30.

Although each upper driving means uses two wire ropes or cables, more than two could be used, and, as in FIG. 1, a single, thicker cable could also replace to the dual cables. If so, it would probably be desirable to have an additional device to compensate against having the ball nut 86 rotate with threaded shaft 82. Turnbuckles may be provided on the cables for precise alignment.

The ball screw actuators provide more precise movement than hydraulic actuators and minimize overshoot. Precise movements are very important. Even though the system is designed to accommodate parts of a wide variety of size and weight, the parts must be moved to within relatively precise distances.

A connection in the form of a cylindrical rod 54 (FIGS. 1 and 5) extend between the first ends 52 of each upper arm 50 to fix the lateral distance between the upper arms and between the lower arms. The upper and lower arms must be sufficiently spaced to accommodate the propellers of the larges pitch so that the propellers will fit between the arms. Rod 54 also causes upper arms 50 to move together. As a result lower arms 30 also move together.

As discussed previously, fixing the separation between the arm mechanisms is important especially when the apparatus is carrying heavy members. When prior art handling systems had to carry heavy, depending objects such as propellers and rudders, two units would have to be used together to support a propeller or rudder handing down between outstretched arms. The weight of the objects would tend to tilt the arms toward each other so that the adjacent units would not be stable, and they would be extremely difficult to control and move together.

Support for Propellers, Rudders and Shafts

As shown primarily in FIG. 1, the present invention overcomes this problem. One propeller attaching outrigger mechanism 101 is shown attached to the upper, second end 51 of upper arm 50. The propeller and rudder holding mechanism 101 shown in the exemplary embodiment of FIG. 1 is somewhat larger than normally needed for many propellers but the dimensions of the parts of outrigger 101 can be varied to accommodate propellers of different sizes. Outrigger 101 of the exemplary embodiment has two side arms 102 and 103, which are spaced a distance apart slightly greater than the distance of outside walls 53 of upper arms 50. Fixed cylinderical shafts 104 and 105 extend inwards from side arms 102 and 103 and rest in U-shaped halfshell bearings 106 and 107 (FIGS. 1 and 4). Shafts 104 and 105 may be secured in bearings 106 and 107 by cotter pins or other similar means. Flanges (only one of which, flange 108, is shown in FIG. 1) extend inward from near the bottom of side arms 102 and 103. In FIG. 1, they rest against the underside of upper arms 50 and prevent propeller and rudder handling mechanism 101 from rotating its front end downward.

In FIG. 1 ship 1 has a four blade propeller 2 mounted aft of keel 3 and fore of rudder 4. To remove propeller 2, the handling device of the present invention is positioned as shown in FIG. 1. A lifting eye (not shown) is attached to the outside of the central hub of propeller 2 between adjacent blades. A cable of chain (not shown) depends from hanger assembly 110 on center brace 111 between side arms 101 and 102. The chain or cable is attached to the lifting eye, and the lower and upper arms 30 and 50 are positioned to support the weight of propeller 2. Then the various attachments holding the propeller 2 on shaft 5 are removed.

Once the propeller 2 is free to slide on propeller shaft 5, base 10 is moved along the dry dock floor in a direction parallel to the axis of shaft 5 until propeller 2 is off shaft 5 as shown in FIG. 1. Because of the position of rudder 4, the handling mechanism will have to mvoe around the rudder, but when it clears the hull of ship 1, the propeller and rudder holding mechanism can be removed from the handling device by the main shipyard overhead crane. The crane hooks ring 112. Cables 113 and 114, which are attached to crossbar 111 by rings 115 and 116, connect the crane through ring 112 to outrigger 101. When the overhead crane lifts outrigger 101 the outrigger pivots upward about shafts 104 and 105 until flanges 108 slide past the front end of upper arms 50. Then, the crane removes the propeller to a storage location or repair location. Normally, mechanism 101 is stored with the propeller.

Figure 8:
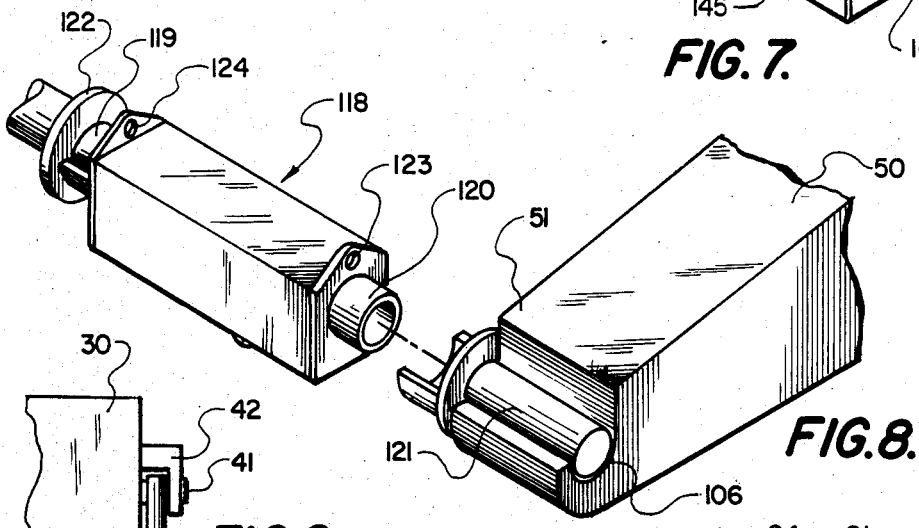
FIG. 8 is a perspective view of one of the carriage members of the present invention and its connection to the upper arm.

A more simplified hanger mechanism 118 is shown in FIG. 8 in he exemplary embodiment. There, hanger mechanism 118 has a pair of outwardly facing trunnion shafts 119 and 120. Hanger mechanism 118 and its outwardly extending shafts 119 and 120 can be sized so that shafts 119 and 120 rest in half bearings 106 and 107 near the front ends 51 of upper arms 50, or they can be held in inwardly facing adapters 121 and 122 (FIG. 8) that are fixed in bearings 106 and 107.

Like its counterpart of hanger mechanism 101 (FIG. 1), the hanger mechanism 118 of FIG. 8 has attaching means 123 and 124 for attaching to cables 113 and 114 attached to ring 112. A depending cable attached to the lifting eye on the supported propeller extends downward from bracket 125.

As shown in FIG. 2, hanger mechanism 118 can also be used for removing rudders. Hanger mechanism 118 has a rudder sling 127 formed of steel or nylon webbing. As shown in FIG. 2, sling 127 straddles rudder 4, and the handling device is moved to position sling 127 under rudder 4 aligned with the rudder's center of gravity 6. Upper arms 50 and lower arms 30 are raised until the sling contacts the bottom of the rudder. One or more securing straps 128 secure fenders 129 to sling 127. Fenders 129 may be positioned as desired for access to the rudder locking bolt. When the bolt is released, the handling device lowers the rudder until it clears the rudder stock. When clear, the handling devices translates outward where the shipyard crane, reaches the hanger mechanism, lifts it out of adapters 121, 122 or half bearings 106, 107 and carries the hanger mechanism 118, strap 127 and the rudder 4 to a location for repair.

Figure 6:
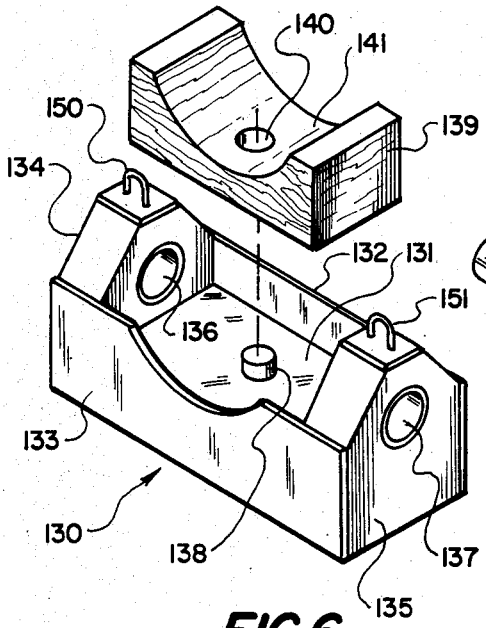
FIGS. 6 and 7 are perspective views of two different propeller shaft carriages.
Figure 7:
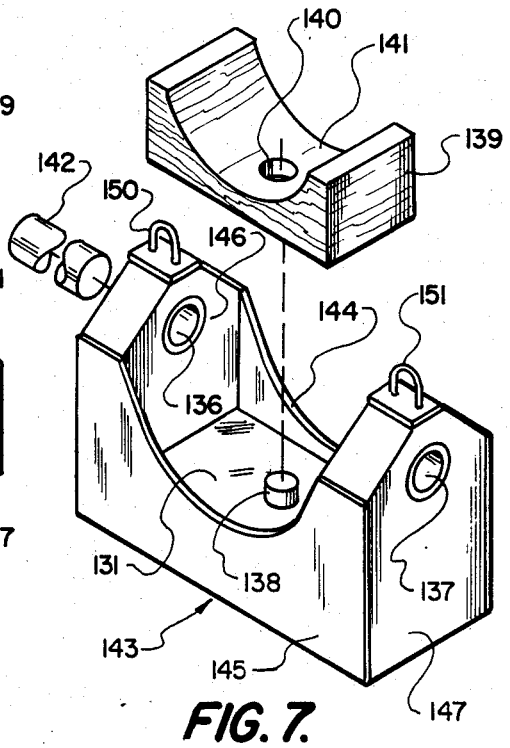

Another difficult task which the handling apparatus of the present invention performs is the removal of propeller shafts. For this operation, as shown in FIG. 3 two units F and A work in tandem. The upper arms 50 of each is fitted with a trunnion mounted gripper best shown in FIGS. 6 and 7. Theses gripper mechanisms are slightly different for reasons set forth below.

Gripper or carriage 130 (FIG. 6) comprises a base 131, parallel rear and front walls 132 and 133 and side walls 134 and 135. Openings 136 and 137 extend respectively through side walls 124 and 135, and trunnion shafts (not shown) extend through these openings outward into U-shaped half bearings 106 and 107 in upper arms 50 where they may be secured a by cotter pins or the like. This mounting permits shaft 130 to pivot as the orientation of arm 50 changes.

Block means in the form of a custom saddleblock 139 of wood or other soft material rests on base 131 with upward shaft 138 projecting into opening 140. The top surface of saddleblock 139 has a generally U-shaped cutout potion 141 having the approximate shape of the outside diameter of a propeller shaft 7 (FIG. 3). The outside dimensions of saddleblock 139 are slightly less than the inside dimensions of gripper member 130 permitting the saddleblock to pivot approximately 6° about upward shaft 138. This feature allows the gripper mechanism to align itself with shaft 7 and allows some play in the movement of the handling devices. The other gripper unit 143 (FIG. 7) is similar to gripper 130 except that walls 144–147 are taller so that base 131 is farther down from openings 136 and 137 and the corresponding trunnion 142.

In operation, design of gripper units 130 and 143 positions propeller shaft 7 slightly above the trunnion 142 in the forward gripper unit 130 on handling unit F (FIG. 3) toward the forward end of the ship 1, but the shaft is below trunnion 142 in the other gripper unit 143 mounted on handling device A at the aft end of the ship. Flexible binder straps 148 and 149 (FIG. 3) secure propeller shaft 7 to the gripper units 130 and 143.

Although the position of the propeller shaft relative to the trunnion may be the same for both the gripper units 130 and 143, the difference is provided for the following reason. As shown in FIG. 3, tail shaft 7 normally extends between drive shaft 8 through strut 9 and then to a propeller. Depending on the hull design of the ship, the end of drive shaft 8 may be very close to the dry dock floor so there is little clearance to the forward end of propeller shaft 7. Strut 9 will normally be higher. By elevating supporter surface 141 of gripper unit 130 slightly above its trunnion 142, greater clearance between arms 50 and the hull occurs.

In operation, a propeller shaft may be removed in a number of different ways. Normally, the forward handling unit F and the aft handling unit A will move together during parts of the operation and separately for other parts. For example, in removing shaft 7, drive 8 may be disconnected. The two handling units then move aft to clear drive 8, and then the arms 30 and 50 of forward unit F are lowered somewhat, and forward unit F is moved starboard. If possible, both handling units may then be moved forward to disengage shaft 7 from strut 9 (FIG. 3). For some other, complicated moves, the entire shaft 7 may have to be pushed through strut 9. In that case, the forward unit F and the aft unit A combine to move together until gripper unit 143 interferes with strut 9. The aft unit A then releases shaft 7 and is repositioned aft of strut 9. The two handling units can then move aft until gripper unit 130 interferes with strut 9, and forward unit F then releases shaft 7 and be repositioned aft of strut 9. Meanwhile, the height of the arms 30 and 50 on both units and the lateral position of the units can be adjusted so that shaft 7 can move without interference through strut 9. What had been a series of complex maneuvers requiring many adjustments to numerous chainfalls and taking more time and labor is reduced to about six moves done quickly.

Because the two arm units 30 and 50 of each handling unit are spread apart, there is no interference between shaft 7 and arms 50 irrespective of the respective height of the arms of each unit. Gripper units 130 and 143 are free to pivot when the arms are at different heights.

Ultimately, the object is to clear the bottom of the hull of ship 1 so that the yard crane can pick up shaft 7. Gripper members 130 and 143 are provided with eyes 150 and 151 (FIGS. 6 and 7) so that hooks depending from the yard crane can pick up shaft 7 through grippers 130 and 143.

All of the removing movements are reversed for reassembly. The units of the present invention can also be used during new construction. Likewise, the handling device could also mount other appendages for removal of sonar transducers or for hull plate structural repairs.

Various modifications and changes may be made in the configuration described above that come within the spirit of this invention. The invention embraces all such changes and modifications coming within the scope of the appended claims.

I claim:

1. A material handling apparatus comprising:

a horizontal base having a width and front and rear portions;

lower arm means comprising a pair of spaced-apart lower arms, each having top and bottom ends, lower pivot means on the bottom end of each lower arm and the base for pivotally mounting the bottom end of each lower arm to the base about an axis extending along the width;

a pair of lower drive means each extending between the base and one of the lower arms for pivoting the lower arms on the base at the lower pivot means;

upper arm means comprising a pair of spaced-apart upper arms, each having a top end for carrying loads and a bottom end opposite the top end, upper pivot means near the bottom end of each upper arm and on the top end of a lower arm for pivotally mounting each upper arm to a lower arm, the portion of each upper arm from the upper pivot means to the top end extending over the lower arm;

a pair of upper drive means each extending between an upper and lower arm for pivoting the upper and lower arms relative to each other each lower drive means comprising a first drive member mounted on the base and a second drive member extending between the first drive member and a lower arm; and engaging means between the first and second drive members and first motor means for driving the first drive member for pulling and pushing the second drive member relative to the first drive member, the first drive member comprising a threaded shaft mounted on and parallel to the base, the second drive member comprising a strut pivoting on the lower arm means and extending to the threaded shaft, the engaging means comprising a thread engaging member on the end of the strut having means for engaging the threaded shaft and moving along the threaded shaft upon rotation of the threaded shaft, the first motor means being operably connected to the threaded shaft for rotating the threaded shaft to move the engaging member along the threaded shaft, the engaging member pulling and pushing the strut to raise and lower a lower arm.

2. The material handling apparatus of claim 1 further comprising separating means on each of the upper arms spaced from the upper pivot means for fixing the lateral distance between the upper arms and between the lower arms and for causing the upper arms to move together and the lower arms to move together.

3. A material handling apparatus comprising:

a horizontal base having a width and front and rear portions;

lower arm means comprising a pair of spaced-apart lower arms, each having top and bottom ends, lower pivot means on the bottom end of each lower arm and the base for pivotally mounting the bottom end of each lower arm to the base about an axis extending along the width;

a pair of lower drive means each extending between the base and one of the lower arms for pivoting the lower arms on the base at the lower pivot means;

upper arm means comprising a pair of spaced-apart upper arms, each having a top end for carrying loads and a bottom end opposite the top end, upper pivot means near the bottom end of each upper arm and on the top end of a lower arm for pivotally mounting each upper arm to a lower arm, the portion of each upper arm from the upper pivot means to the top end extending over the lower arm; and a pair of upper drive means each extending between an upper and lower arm for pivoting the upper and lower arms relative to each other wherein each upper drive means comprises an upper shaft extending from the lower arm means to connecting means attached to the bottom end of the upper arm, the connecting means being secured to the upper shaft, travel means for moving the connecting means along the upper shaft for pulling and releasing the bottom end of the upper arm means to pivot the upper arm means about the upper pivot means, the bottom end of the upper arm means has a curve portion, the connecting means extending along the underside of the curve portion and being fixed to the bottom end of the upper arm means, the travel means being fixed to the connecting means at the end of the connecting means opposite its connection to the upper arm means, the travel means having means for moving along the upper shaft to move the connecting means to pivot the upper arm means.

4. The material handling apparatus of claim 3 wherein the upper shaft is threaded, second motor means attached to the upper shaft for rotating the upper shaft, the travel means having means for engaging the threaded upper shaft for movement along the upper shaft when the upper shaft is rotated, and means on the travel means for preventing rotation of the travel means with the upper shaft when the second motor means rotates the upper shaft.

5. The material handling apparatus of claim 3 wherein the connecting means comprises a flexible member lying along the curve portion of the upper arm and engaging the bottom of the upper arm.

6. A material handling apparatus comprising:

a horizontal base having a width and front and rear portions;

lower arm means comprising a pair of spaced-apart lower arms, each having top and bottom ends, lower pivot means on the bottom end of each lower arm and the base for pivotally mounting the bottom end of each lower arm to the base about an axis extending along the width;

a pair of lower drive means each extending between the base end and one of the lower arms for pivoting the lower arms on the base at the lower pivot means;

upper arm means comprising a pair of spaced-apart upper arms, each having a top end for carrying loads and a bottom end opposite the top end, upper pivot means near the bottom end of each upper arm and on the top end of a lower arm for pivotally mounting each upper arm to a lower arm, the portion of each upper arm from the upper pivot means to the top end extending over the lower arm, a pair of upper drive means each extending between an upper and lower arm for pivoting the upper and lower arms relative to each other; and a carriage and receiving means at the top of each upper arm for receiving the carriage between the upper arms, the carriage comprising a pair of shafts extending outwardly into the receiving means, the receiving means receiving the shafts for pivoting the carriage freely between the upper arms relative to the ground.

7. The material handling apparatus of claim 6 further comprising block means receivable within the carriage for supporting from below an object, means on the carriage for mounting the block means for pivoting about a generally vertical axis to permit the block means to align itself with the object being supported.

8. A material handling apparatus comprising a generally horizontal base, the base having forward, central and rear sections, motive means under the base for allowing movement of the base along the ground, a pair of lower arms, each having a lower and an upper end, lower pivot means for pivotally mounting the lower end of each lower arm about a pivot axis toward or away from the rear section of the base and over the base, lower drive means between the base and the lower arms for pivoting the lower arms about its pivot axis, a pair of upper arms, each having an upper and a lower end, upper pivot means between the lower end of the upper arm and the upper end of the lower arm for allowing pivoting of the upper arms relative to the lower arm about an axis parallel to the axis of the pivoting of the lower arms toward and away from the forward section of the base and over the base, upper drive means between the upper and lower arms for pivoting the upper arms about its pivot axis, carriage means for supporting a load, the carriage means including a pair of outwardly extending shafts, receiving means on the upper end of each upper arm, each receiving means receiving a shaft of the carriage means, carriage pivoting means for permitting rotation of the carriage about the axes of the shafts relative to the receiving means, the axis of the shaft being generally parallel to the axis of the lower pivot means, block means receivable within the carriage means for supporting from below an object, and means on the carriage means for mounting the block means for pivoting about a generally vertical axis to permit the block means to align itself with the object being supported.

* * * * *